US007448627B2

(12) United States Patent
Vachon

(10) Patent No.: US 7,448,627 B2
(45) Date of Patent: Nov. 11, 2008

(54) PACKAGING STRUCTURE AND METHOD

(76) Inventor: Francois Vachon, 791, Boac De Tasu, Si.Sulpice, Quebec (CA) J6W 4K8

( * ) Notice: Subject to any disclaimer, the term of this patent is extended or adjusted under 35 U.S.C. 154(b) by 110 days.

(21) Appl. No.: 11/116,305

(22) Filed: Apr. 28, 2005

(65) Prior Publication Data

US 2006/0243623 A1 Nov. 2, 2006

(51) Int. Cl.
*A63F 9/08* (2006.01)

(52) U.S. Cl. ..... 273/156; 273/153 R

(58) Field of Classification Search ..... 273/153 R, 273/159, 156; D21/482
See application file for complete search history.

(56) References Cited

U.S. PATENT DOCUMENTS 257,655 A * 5/1882 Campbell ..... 273/159
1,281,350 A * 10/1918 Gray ..... 273/159
2,040,740 A * 5/1936 Heimers ..... 273/153 R
4,759,238 A * 7/1988 Farfalli ..... 81/3.09
D413,262 S * 8/1999 Cardinaletti ..... D9/439
D422,214 S * 4/2000 Hollinger ..... D9/439
D479,735 S * 9/2003 Hudson ..... D21/481

* cited by examiner

*Primary Examiner*—Steven Wong

(57) ABSTRACT

A packaging structure for packaging an object. The packaging structure includes an object receiving portion for receiving the object at least partially thereinto. A retaining assembly is provided for selectively retaining the object within the object receiving portion. The retaining assembly is operable between a non-retaining and a retaining configuration wherein the retaining assembly respectively allows and prevents removal of the object from the object receiving portion. A lock releasably locks the retaining assembly in the retaining configuration. The lock is operable between a locked configuration and a non-locked configuration for respectively selectively locking the retaining assembly in the retaining configuration and allowing the retaining assembly to be moved to the non-retaining configuration. The lock includes a puzzle that allows the lock to be operated from the locked configuration to the unlocked configuration upon the puzzle being solved. The puzzle includes an object accessory usable for operatively engaging the object and performing a predetermined accessory function thereof.

9 Claims, 4 Drawing Sheets

PACKAGING STRUCTURE AND METHOD

FIELD OF THE INVENTION

The present invention relates to the general field of packaging. More specifically, the present invention is concerned with a packaging structure and method.

BACKGROUND OF THE INVENTION

There exist many types of packaging, for example for packaging gifts. In one such type of packaging, ornamental packaging is used to hide the gift from view until the package is opened. For example, wrapping paper is used to wrap gifts that are to be displayed under a Christmas tree, sometimes for many days before they are unwrapped.

While relatively inexpensive and convenient, such packaging typically serves only an ornamental purpose. Other types of packaging having additional functionality have therefore been developed.

In one such type of packaging, a gift is locked inside the packaging through a lock. The lock includes a puzzle that must be solved in order to release the object.

While having more uses than purely ornamental packaging, this type of packaging is also of relatively limited use. Indeed, once the puzzle has been solved and the object removed from the packaging, the packaging becomes relatively useless, except to serve once more to package another object.

Against this background, there exists a need in the industry to provide a novel packaging structure and method.

OBJECTS OF THE INVENTION

An object of the present invention is therefore to provide an improved packaging structure and method.

SUMMARY OF THE INVENTION

In a first broad aspect, the invention provides a packaging structure for packaging an object. The packaging structure includes an object receiving portion for receiving the object at least partially thereinto. A retaining assembly is provided for selectively retaining the object within the object receiving portion. The retaining assembly is operable between a non-retaining and a retaining configuration wherein the retaining assembly respectively allows and prevents removal of the object from the object receiving portion. A lock releasably locks the retaining assembly in the retaining configuration. The lock is operable between a locked configuration and an unlocked configuration for respectively selectively locking the retaining assembly in the retaining configuration and allowing the retaining assembly to be moved to the non-retaining configuration. The lock includes a puzzle that allows the lock to be operated from the locked configuration to the unlocked configuration upon the puzzle being solved. The puzzle includes an object accessory usable for operatively engaging the object and performing a predetermined accessory function thereon.

In a specific example of implementation, the object includes a bottle packagable within the packaging structure. The puzzle includes an object accessory in the form of a corkscrew that is usable for opening the bottle once the puzzle is solved and the object removed from the retaining assembly.

However, in alternative embodiments of the invention, the packaging is any packaging. Also, in alternative embodiments of the invention, the object accessory is any other suitable object accessory.

Advantageously, the packaging structure includes an object accessory that adds functionality to the packaging structure. Indeed, after the packaging structure has been opened, the packaging structure is still useful for performing another function. In the case wherein the object accessory is a corkscrew and the object is bottle, the packaging structure ensures that when the puzzle is solved, a corkscrew is readily available for opening the bottle.

In addition, the puzzle itself is entertaining so that if the packaging structure and the object are given as gifts to an intended user, the intender user in fact receives two gifts.

In some embodiments of the invention, the packaging structure is relatively ergonomic, relatively inexpensive to manufacture and relatively safe to use. Also, the packaging structure, in some embodiments of the invention, does not require the use of a specialized tool to operate.

In another broad aspect, the invention provides a package comprising in combination a bottle and a packaging structure for packaging the bottle.

In another broad aspect, the invention provides a method for packaging an object. The method includes providing the object and providing an object receiving portion for receiving the object at least partially thereinto. The method further includes locking the object within the object receiving portion through a lock, the lock including a puzzle that allows the lock to be selectively unlocked upon the puzzle being solved. The puzzle includes an object accessory usable for operatively engaging the object and performing a predetermined accessory function thereon.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings in which.

DETAILED DESCRIPTION

Figure 1:
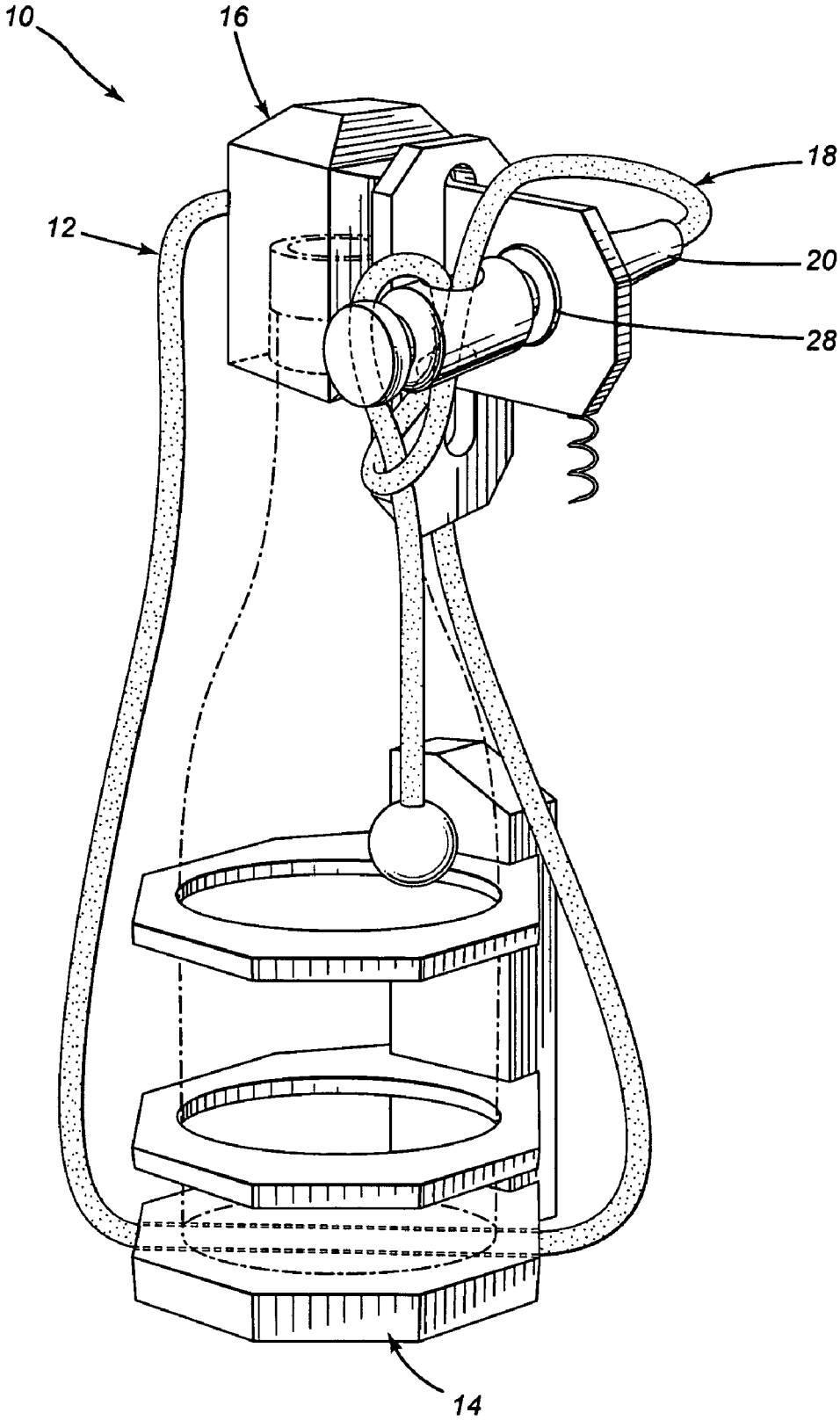
FIG. 1 illustrates, in a perspective view, a packaging structure for packaging an object, the packaging structure including a retaining assembly in a retaining configuration and a lock in a locked configuration.
Figure 2:
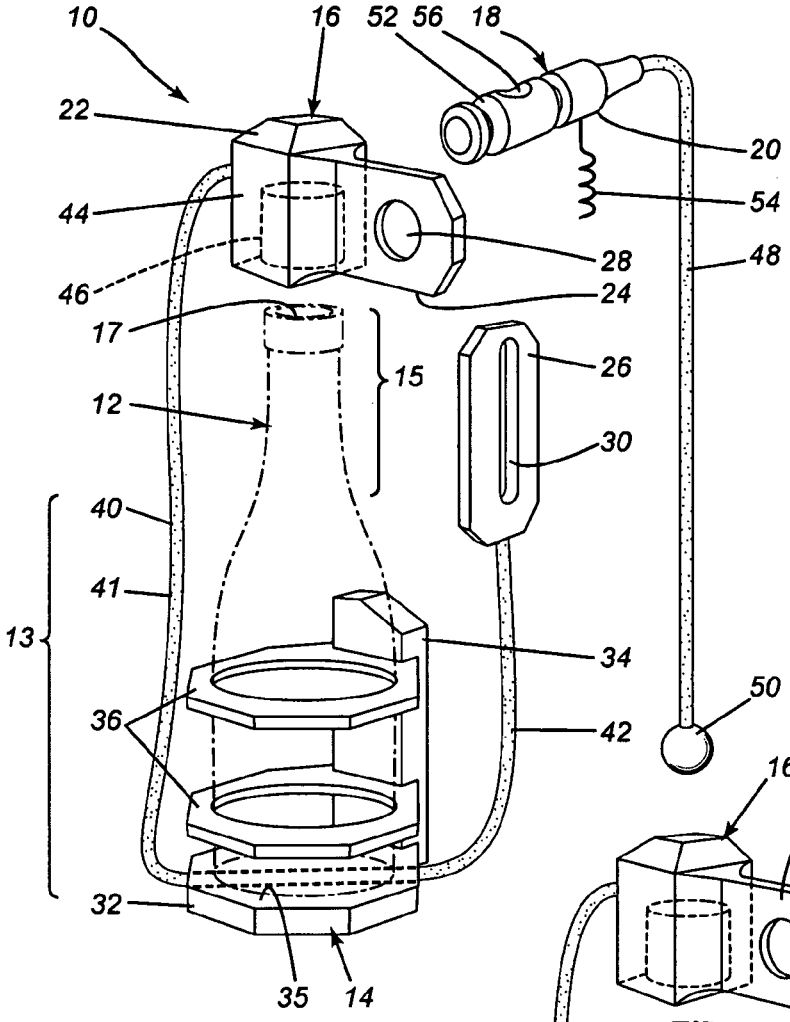
FIG. 2 illustrates, in a perspective view, the packaging structure of FIG. 1 with the retaining assembly in a non-retaining configuration and the lock in an unlocked configuration.

FIGS. 1 and 2 illustrate a packaging structure 10 for packaging an object in the form of a bottle 12. The packaging structure 10 includes an object receiving portion 14 for receiving the bottle 12 at least partially thereinto. The packaging structure 10 further includes a retaining assembly 16 for selectively retaining the bottle 12 within the object receiving portion 14.

The bottle 12 includes a body 13 and a neck 15 extending from the body 13. The neck 15 defines a spout 17 allowing to pour a liquid contained within the bottle 12.

FIG. 1 shows the packaging structure 10 with the retaining assembly 16 in a retaining configuration. In the retaining configuration, the retaining assembly 16 prevents removal of the bottle 12 from the object receiving portion 14. FIG. 2 illustrates the retaining assembly 16 in a non-retaining configuration. In the non-retaining configuration, the retaining assembly 16 allows removal of the bottle 12 from the object receiving portion 14.

The packaging structure 10 further includes a lock 18 for releasably locking the retaining assembly 16. The lock 18 includes a puzzle that allows the lock 18 to be operated from a locked configuration to an unlocked configuration upon the puzzle being solved.

The puzzle includes an object accessory usable for operatively engaging the object and performing a predetermined accessory function thereon. For example, in the embodiment of the invention shown in FIGS. 1 and 2, the object accessory takes the form of a corkscrew 20 and the predetermined action includes opening the bottle 12.

FIG. 1 illustrates the lock 18 in a locked configuration wherein the lock 18 locks the retaining assembly 16 in the retaining configuration. FIG. 2 illustrates the lock 18 in an unlocked configuration wherein the retaining assembly 16 is movable from the retaining configuration to the non-retaining configuration.

The reader skilled in the art will readily appreciate that although the packaging structure 10 is a packaging structure for packaging a bottle 12, it is within the scope of the invention to have packaging structures for packaging any other suitable object. Also, the reader skilled in the art will readily appreciate that the packaging structure 10 is only an example of a packaging structure and that alternative embodiments of the invention including alternative retaining assemblies, alternative object receiving portions, alternative object accessories and alternative locks are within the scope of the invention.

As better seen in FIG. 2, the object receiving portion 14 is configured and sized to receive at least in part the body 13 of the bottle 12 while the retaining assembly 16 is configured and sized to receive at least in part the neck 15 of the bottle 12. In the retaining configuration, the object receiving portion 14 limits a movement of the bottle 12 to a single direction. The retaining assembly 16 limits a movement of the bottle 12 along that direction, thereby insuring that the bottle 12 is maintained within the packaging structure 10.

The reader skilled in the art will readily appreciate that it is also within the scope of the invention to have an alternative retaining assembly that limits a movement of the bottle 12 to a single direction with an alternative object receiving portion that limits a movement of the bottle 12 along that direction, thereby insuring that the bottle 12 is maintained within the packaging structure.

As seen in FIG. 2, the object receiving portion 14 includes a base plate 32. A longitudinal member 34 extends substantially upwardly and peripherally from the base plate 32. At least one circumferential member 36 of generally annular shape extends substantially parallel to the base plate 32 from the longitudinal member 34. The circumferential member 36 and the base plate 32 only allow a movement of the bottle 36 along a direction substantially perpendicular to the circumferential member 36 and oriented away from the base plate 32.

In the drawings, two circumferential members 36 are shown. However, it is within the scope of the invention to have any other suitable number of circumferential members. Also, it is within the scope of the invention to allow a movement of the bottle 12 along only a single direction in any suitable alternative manner.

The base plate 32 defines a rope receiving passageway 35 extending therethrough. The rope receiving passageway 35 slidably receives a retaining rope 41 therethrough, as further described hereinbelow.

The retaining assembly 16 includes a lid 22 connected to the object receiving portion 14, a retaining assembly first member 24 extending from the lid 22, and a retaining assembly second member 26. The retaining assembly second member 26 is configured and sized for engaging the retaining assembly first member 24.

In the embodiment of the invention shown in FIG. 2, the retaining assembly first member 24 defines a closing aperture 28 for receiving at least in part the lock 18 therethrough in the locked configuration. In the locked configuration, as shown in FIG. 1, the lock 18 prevents an operation of the retaining assembly 16 from the retaining configuration to the non-retaining configuration when the lock 18 is received in the closing aperture 28. However, in alternative embodiments of the invention (not shown in the drawings), the closing aperture 28 is defined in a retaining assembly second member 26.

Referring to FIG. 2, the retaining assembly second member 26 is substantially planar and defines an engagement aperture 30 extending therethrough for receiving at least in part the retaining assembly first member 24. In the retaining configuration, the retaining assembly second member 26 is provided between the lid 22 and the closing aperture 28, as shown in FIG. 1. Therefore, in this configuration, the lock 18 prevents a relative motion between the retaining assembly first and second members 24 and 26 through an abutting contact of the retaining assembly second member 26 with the lock 18.

The lid 22 is connected to the object receiving portion 14 through a first generally elongated substantially flexible element. An example of such a first flexible element is a first piece of rope 40. Also, the retaining assembly second member 26 is also connected to the object receiving portion 14 through a second generally elongated substantially flexible element. An example of such a second generally elongated flexible element is a second piece of rope 42. However, the reader skilled in the art will readily appreciate that in alternative embodiments of the invention the first and second generally elongated flexible elements may take any other suitable form.

In some embodiments of the invention, each of the first and second pieces of rope 40 and 42 extend from the base plate 32. In other embodiments of the invention, as shown in the drawings, the first and second pieces of rope 40 and 42 are part of a single retaining rope 41 that extends through the base plate 32 within the rope receiving passageway 35. The length of the retaining rope 41 is such that in the retaining configuration, the bottle 12 is prevented from being removed from the object receiving portion 14.

The lid 22 is any suitable lid. For example, the lid 22 includes a substantially parallelepiped shaped body 44 into which a recess 46 extends. The recess 46 is dimensioned to receive at least in part the bottle 12. The retaining assembly first member 24 is substantially planar and extends from the lid 22.

The lock 18 includes the corkscrew 20, a lock rope 48 and a lock end member 50. The lock rope 48 connects the lock end member 50 to the corkscrew 20.

The corkscrew 20 includes a corkscrew handle 52 and a substantially helicoidal member 54 for engaging a cork. The helicoidal member 54 extends substantially perpendicularly from the corkscrew handle 52.

The corkscrew handle 52 is of generally cylindrical shape and defines a handle aperture 56 extending therethrough. In some embodiments of the invention, the handle aperture 56 is substantially cylindrical. However, it is within the scope of the invention to have handle apertures of any other suitable shape.

In some embodiments of the invention, the handle aperture 56 is dimensioned so as to prevent an insertion of the lock end member 50 therethrough. In these embodiments, in the locked configuration, the puzzle is created, at least in part, by an appearance that to unlock the lock 18, it would be required to insert the lock end member 50 through the closing aperture 28, which is not possible.

The corkscrew handle 52 is insertable through the closing aperture 28, but the helicoidal member 54 limits the movement of the corkscrew 20 through the closing aperture 28. It is therefore only possible to move the corkscrew handle 52 through the closing aperture 28 in a single direction to unlock the lock. However, the lock rope 48 is then used to substantially prevent this movement unless the puzzle is solved, as seen in FIG. 1

In use, the body 13 of the bottle 12 is first inserted into the object receiving portion 14. Then, the lid 22 is positioned so that the recess 46 engages at least in part the neck 15 of the bottle 12 and the retaining assembly second member 26 receives the retaining assembly first member 24 through the engagement aperture 30. This creates the retaining configuration. Then, the corkscrew handle 52 is inserted through the closing aperture 28 until the helicoidal member 54 is substantially adjacent the retaining assembly first member 24.

Subsequently, as shown in FIGS. 4A through 4F, the lock 18 is locked. In the following description of FIGS. 4A to 4F, and in the subsequent description of FIGS. 5A to 5E, directional terms such as up, down, left and right are used. These directional terms suppose that the bottle 12 is upright into the packaging assembly 10 and that the packaging assembly 10 is positioned so that the corkscrew handle 52 is seen substantially along its longitudinal axis with the helicoidal member 54 behind the retaining assembly first member 24. However, the reader skilled in the art will readily appreciate that this frame of reference is used for reasons of clarity and should therefore not be used to restrict the scope of the invention.

Figure 4A:
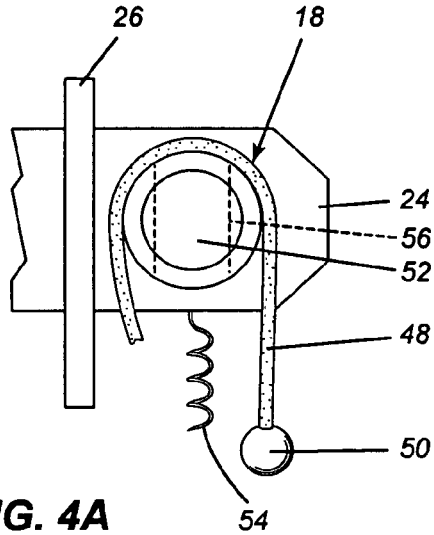
FIG. 4A illustrates, in a front elevation view, the lock of FIG. 1 at a first step of a method for locking the lock.
Figure 4B:
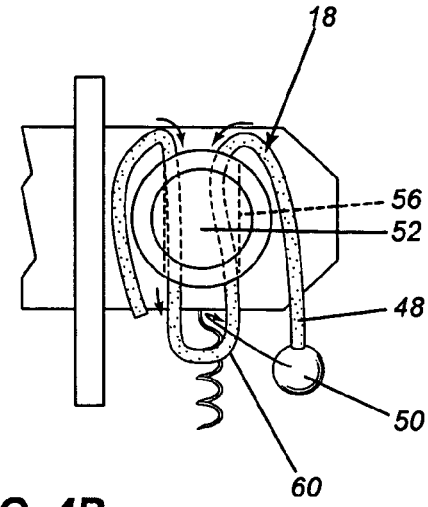
FIG. 4B illustrates, in a front elevation view, the lock of FIG. 1 at a second step of a method for locking the lock.

First, as shown in FIG. 4A, the lock rope 48 is passed over the corkscrew handle 52 so that the lock end member 50 hangs on the right of the corkscrew handle 52. Then, a portion of the lock rope 48 located over the handle aperture 56 is pulled through the handle aperture 56 and forms a first loop 60 below the corkscrew handle 52. This is shown in FIG. 4B.

Figure 4C:
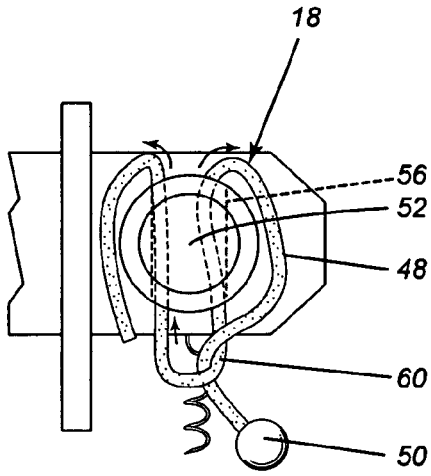
FIG. 4C illustrates, in a front elevation view, the lock of FIG. 1 at a third step of a method for locking the lock.

Subsequently, the lock end member 50 is inserted through the first loop 60, as shown in FIG. 4C. The lock end member 50 is inserted from front to back into the first loop 60.

Figure 4D:
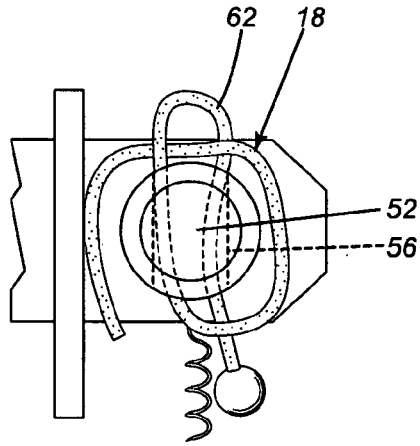
FIG. 4D illustrates, in a front elevation view, the lock of FIG. 1 at a fourth step of a method for locking the lock.

The lock rope 48 is then pulled through the handle aperture 56 so that the first loop 60 disappears and a second loop 62 is formed. The second loop 62 is formed by a region of the lock rope 48 that has been pulled by the first loop 60 through the handle aperture 56. As shown in FIG. 4D, the second loop 62 extends substantially upwardly from the handle aperture 56.

Figure 4E:
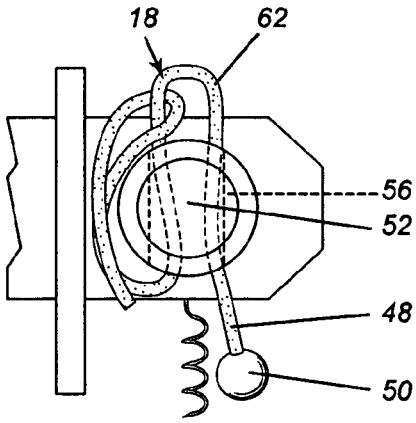
FIG. 4E illustrates, in a front elevation view, the lock of FIG. 1 at a fifth step of a method for locking the lock.
Figure 4F:
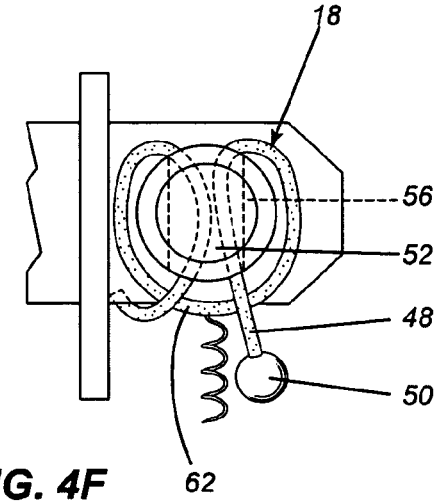
FIG. 4F illustrates, in a front elevation view, the lock of FIG. 1 at a sixth a step of a method for locking the lock.

Afterwards, a portion of the lock rope 48 that remains at the right of the corkscrew handle 52 is then moved to the left of the corkscrew handle 52. This is shown in FIG. 4E. Then, the second loop 62 is passed downwardly in front of the corkscrew handle 52 and the lock end member 50 is inserted from back to front through the second loop 62. The configuration achieved is the locked configuration, which is shown in. FIG. 4F.

Figure 5A:
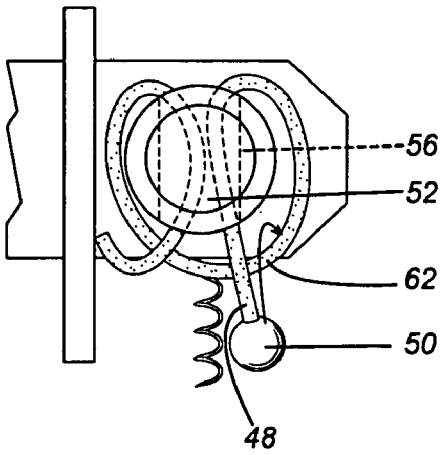
FIG. 5A illustrates, in a front elevation view, the lock of FIG. 1 at a first step of a method for unlocking the lock.
Figure 5B:
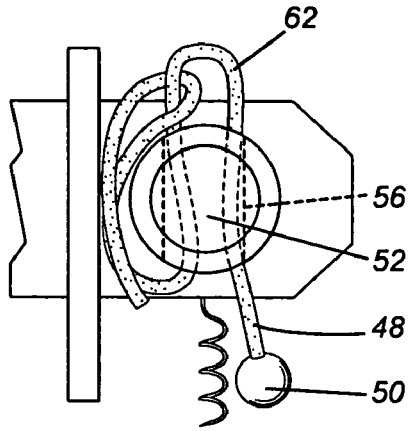
FIG. 5B illustrates, in a front elevation view, the lock of FIG. 1 at a second step of a method for unlocking the lock.

To unlock the lock 18, this sequence of events is reversed, as illustrated in FIGS. 5A through 5E. FIG. 5A illustrates that to unlock the lock 18, the lock end member 50 is first inserted from front to back through the second loop 62. Then, the second loop 62 is passed upwardly in front of the corkscrew handle 52 so as to be positioned over the handle aperture 56, as shown in FIG. 5B.

Figure 5C:
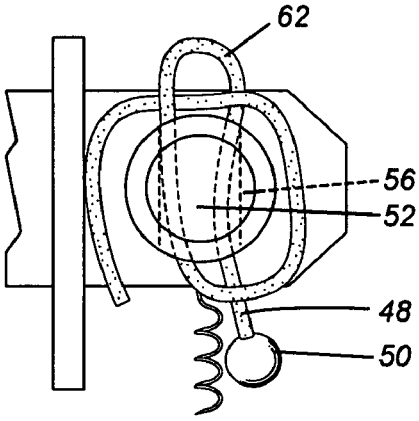
FIG. 5C illustrates, in a front elevation view, the lock of FIG. 1 at a third step of a method for unlocking the lock.
Figure 5D:
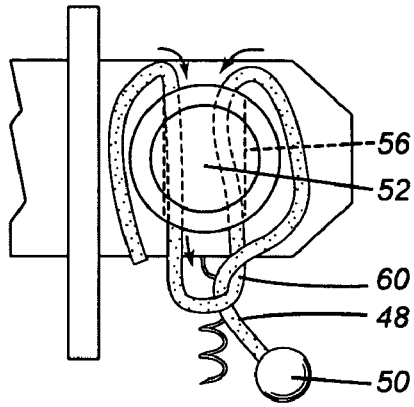
FIG. 5D illustrates, in a front elevation view, the lock of FIG. 1 at a fourth step of a method for unlocking the lock.
Figure 5E:
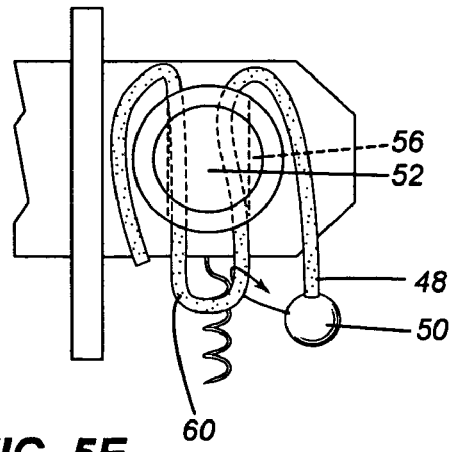
FIG. 5E illustrates, in a front elevation view, the lock of FIG. 1 at a fifth step of a method for unlocking the lock.

Subsequently, a portion of the lock rope 48 that was passed to the left of the corkscrew handle 52 between FIGS. 4D and 4E is passed back to the right of the corkscrew handle 52 to obtain the configuration illustrated in FIG. 5C. The second loop 62 is afterwards passed downwardly through the handle aperture 56 to form the first loop 60, as seen in FIG. 5D, and the lock end member 50 is passed from back to front through the first loop 60 to obtain the configuration illustrated by FIG. 5E. This allows freeing the lock rope 48 from the handle aperture 56 by pulling upwardly onto the portions of the lock rope 48 that are then in proximity of the upper portion of the handle aperture 56.

Figure 3:
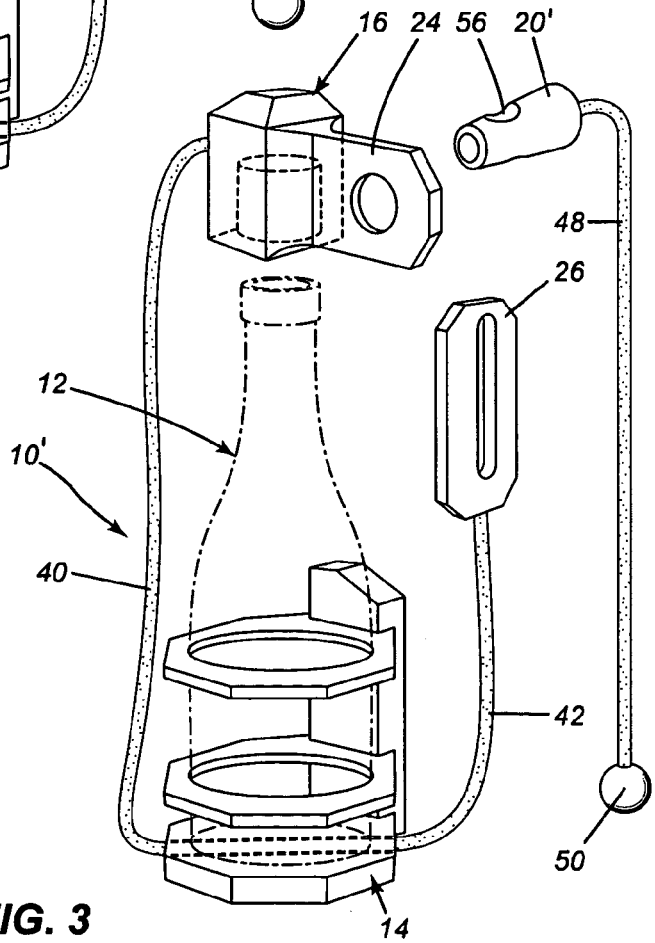
FIG. 3 illustrates, in a perspective view, an alternative packaging structure with a retaining assembly in a non-retaining configuration and a lock in an unlocked configuration.

FIG. 3 illustrates an alternative a packaging structure 10' substantially similar to the packaging structure 10 with the exception that the corkscrew 20 is replaced by a wine stopper 20'. The wine stopper 20' is substantially tapered so that it is only partially insertable through the closing aperture 28. Therefore, the predetermined function performed by an object accessory in the form of the wine stopper 20' is closing the wine bottle further to its opening.

Although the present invention has been described hereinabove by way of preferred embodiments thereof, it can be modified, without departing from the spirit and nature of the subject invention as defined in the appended claims.

What is claimed is:

1. A packaging structure for packaging an object, said packaging structure comprising:

an object-receiving portion for receiving the object at least partially thereinto, said object-receiving portion being configured and sized to receive a bottle;

a retaining assembly for selectively retaining the object within said object-receiving portion, said retaining assembly being operable between a non-retaining and a retaining configuration wherein said retaining assembly respectively allows and prevents removal of the object from said object-receiving portion, said retaining assembly including a lid connected to said object-receiving portion through a first generally elongated and substantially flexible element, a retaining assembly first member extending from said lid, and a retaining assembly second member configured and sized for engaging said retaining assembly first member, said retaining assembly second member being connected to said object-receiving portion through a second generally elongated and substantially flexible element and defining an engagement aperture for receiving at least in part said retaining assembly first member therethrough; and a lock for releasably locking said retaining assembly in said retaining, configuration, said lock being operable between a locked configuration and an unlocked configuration for respectively selectively locking said retaining assembly in said retaining configuration and allowing said retaining assembly to be moved to said non-retaining configuration;

said lock including a puzzle that allows said lock to be operated from said locked configuration to said unlocked configuration upon the puzzle being solved;

said retaining assembly first member defining a closing aperture for receiving at least in part said lock therethrough in said locked configuration;

in said retaining configuration, said retaining assembly second member being provided between said lid and said closing aperture, said lock preventing an operation of said retaining assembly from said retaining configuration to said non-retaining configuration when received by said closing aperture;

wherein said puzzle includes an object accessory configured and sized so as to limit a movement of said object accessory through said closing aperture, said object accessory being usable for operatively engaging the object and performing a predetermined accessory function thereon, said object accessory engaging said closing aperture when said lock is in said locked configuration.

2. A packaging structure as defined in claim 1, wherein:

said first and second flexible elements include respectively a first piece of rope and a second piece of rope;

said second piece of rope extends integrally from said first piece of rope, thereby forming a retaining rope; and said object receiving portion defines a rope receiving passageway extending therethrough, said rope receiving passageway slidably receiving said retaining rope therethrough.

3. A packaging structure as defined in claim 1, wherein said lid defines a lid recess for receiving at least in part a neck of the bottle.

4. A packaging structure as defined in claim 1, wherein said object accessory includes a corkscrew.

5. A packaging structure as defined in claim 4, wherein said corkscrew includes a corkscrew handle and a substantially helicoidal member extending from said corkscrew handle.

6. A packaging structure as defined in claim 5, wherein said corkscrew handle is substantially perpendicular to said helicoidal member.

7. A packaging structure for packaging an object, said packaging structure comprising:

an object-receiving portion for receiving the object at least partially thereinto, said object-receiving portion being configured and sized to receive a bottle;

a retaining assembly for selectively retaining the object within said object-receiving portion, said retaining assembly being operable between a non-retaining configuration and a retaining configuration wherein said retaining assembly respectively allows and prevents removal of the object from said object-receiving portion, said retaining assembly including a lid connected to said object-receiving portion, a retaining assembly first member extending from said lid, and a retaining assembly second member configured and sized for engaging said retaining assembly first member, said retaining assembly second member defining an engagement aperture for receiving at least in part said retaining assembly first member therethrough; and a lock for releasably locking said retaining assembly in said retaining configuration, said lock being operable between a locked configuration and an unlocked configuration for respectively selectively locking said retaining assembly in said retaining configuration and allowing said retaining assembly to be moved to said non-retaining configuration said lock including a puzzle that allows said lock to be operated from said locked configuration to said unlocked configuration upon the puzzle being solved;

said retaining assembly first member defining a closing aperture for receiving at least in part said lock therethrough in said locked configuration;

in said retaining configuration, said retaining assembly second member being provided between said lid and said closing aperture, said lock preventing an operation of said retaining assembly from said retaining configuration to said non-retaining configuration when received by said closing aperture;

wherein said puzzle includes an object accessory configured and sized so as to limit a movement of said object accessory through said closing aperture, said object accessory being usable for operatively engaging the object and performing a predetermined accessory function thereon, said object accessory engaging said closing aperture when said lock is in said locked configuration, said object accessory including a corkscrew, said corkscrew including a corkscrew handle and a substantially helicoidal member extending from said corkscrew handle substantially perpendicularly thereto, said corkscrew handle being insertable through said closing aperture and said helicoidal member limiting a movement of said corkscrew through said closing aperture.

8. A packaging structure as defined in claim 1, wherein said object accessory includes a wine stopper for substantially obstructing a spout of the bottle.

9. A packaging structure as defined in claim 8, wherein said wine stopper is substantially tapered.

* * * * *